US010969134B2

(12) United States Patent
Zhang et al.

(10) Patent No.: US 10,969,134 B2
(45) Date of Patent: Apr. 6, 2021

(54) AIR CONDITIONER AND METHOD FOR SELF-CLEANING AIR CONDITIONER HEAT EXCHANGER

(71) Applicant: Qingdao Haier Air Conditioner General Corp., Ltd., Shandong (CN)

(72) Inventors: Mingjie Zhang, Shandong (CN); Yu Fu, Shandong (CN); Hongjin Wu, Shandong (CN); Fei Wang, Shandong (CN); Youning Wang, Shandong (CN)

(73) Assignee: Qingdao Haier Air Conditioner General Corp., Ltd., Shandong (CN)

( * ) Notice: Subject to any disclaimer, the term of this patent is extended or adjusted under 35 U.S.C. 154(b) by 134 days.

(21) Appl. No.: 15/978,063

(22) Filed: May 11, 2018

(65) Prior Publication Data

US 2018/0259216 A1 Sep. 13, 2018

Related U.S. Application Data

(63) Continuation-in-part of application No. PCT/CN2016/108395, filed on Dec. 2, 2016.

(30) Foreign Application Priority Data

Nov. 11, 2016 (CN) ..... 201611040895.7

(51) Int. Cl.
*F24F 11/65* (2018.01)
*F24F 11/41* (2018.01)
(Continued)

(52) U.S. Cl.
CPC ..... *F24F 11/65* (2018.01); *F24F 11/41* (2018.01); *F24F 11/64* (2018.01); *F24F 11/70* (2018.01);
(Continued)

(58) Field of Classification Search
CPC .. F24F 11/65; F24F 11/64; F24F 11/41; F24F 11/70; F24F 2110/10; F24F 49/02; F25B 49/02
See application file for complete search history.

(56) References Cited

FOREIGN PATENT DOCUMENTS

CN 1702406 A 11/2005
CN 101256061 A 9/2008
(Continued)

OTHER PUBLICATIONS

Yongzhen et al., Cleaning Method for Heat Exchangerof Air Conditioner, May 25, 2016, CN105605742A, Whole Document (Year: 2016).*

(Continued)

*Primary Examiner* — Larry L Furdge
(74) *Attorney, Agent, or Firm* — Marshall, Gerstein & Borun LLP

(57) ABSTRACT

A self-cleaning method for an air-conditioner heat exchanger is provided and includes: controlling an air-conditioner to enter a self-cleaning mode; detecting an ambient temperature of a to-be-cleaned heat exchanger, and determining, according to the detected ambient temperature, a target evaporating temperature of the to-be-cleaned heat exchanger; adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost; and after a surface of the to-be-cleaned heat exchanger is covered with a frost layer or an ice layer, controlling the air conditioner to enter a defrosting mode of the to-be-cleaned heat exchanger.

9 Claims, 3 Drawing Sheets

(51) Int. Cl.

| | |
|---|---|
| ***F24F 11/64*** | (2018.01) |
| *F24F 110/10* | (2018.01) |
| *F25B 49/02* | (2006.01) |
| *F24F 11/70* | (2018.01) |

(52) U.S. Cl.
CPC ..... *F24F 2110/10* (2018.01); *F24F 2221/22* (2013.01); *F25B 49/02* (2013.01)

(56) References Cited

FOREIGN PATENT DOCUMENTS

| | | | | |
|---|---|---|---|---|
| CN | 104359188 | | | 2/2015 |
| CN | 104406251 | | | 3/2015 |
| CN | 104833067 | A | * | 8/2015 |
| CN | 104848481 | A | | 8/2015 |
| CN | 104848507 | A | | 8/2015 |
| CN | 104848738 | | | 8/2015 |
| CN | 104930669 | A | | 9/2015 |
| CN | 104949261 | | | 9/2015 |
| CN | 105202724 | A | | 12/2015 |
| CN | 105465979 | A | * | 4/2016 |
| CN | 105465979 | A | | 4/2016 |
| CN | 105486164 | | | 4/2016 |
| CN | 105605742 | | | 5/2016 |
| CN | 105605742 | A | * | 5/2016 |
| CN | 205261970 | | | 5/2016 |
| CN | 105783199 | | | 7/2016 |
| DE | 4134282 | A1 | | 4/1993 |
| JP | S5467252 | A | * | 5/1979 |
| JP | 2006275509 | A | | 10/2006 |
| JP | 2009192164 | A | * | 8/2009 |
| JP | 2010-14288 | A | | 1/2010 |
| JP | 2015-190691 | A | | 11/2015 |
| KR | 2001-0089909 | A | | 10/2001 |

OTHER PUBLICATIONS

Katayama, Refrigerating Unit, May 30, 1979, JPS5467252A, Whole Document (Year: 1979).*
Zhang et al., Method and Device for . . . Cleaning Air Conditioner, Aug. 12, 2015, CN1048833067A, Whole Document (Year: 2015).*
Kibe et al., Refrigerating Apparatus, Aug. 27, 2009, JP2009192164A, Whole Document (Year: 2009).*
Tian, Control Method and Device for Automatic Cleaning . . . Air Conditioning System, Apr. 4, 2016, CN105465979A, Whole Document (Year: 2016).*
Office Action from Japanese Application No. 2017-556729 dated Dec. 7, 2018.
International search report and written opinion from PCT/CN2016/108395 dated Aug. 17, 2017.
Office Action from European Application No. 16 840 288.1 dated Sep. 26, 2019.
Search Report from European Application No. 16840288.1 dated Sep. 26, 2018.
Office Action from Australian Application No. 2016409528 dated Oct. 8, 2019.
Office Action from Japanese Application No. 2017-556729 dated Aug. 29, 2019.
Search Report from Russian Application No. 2017111509/12 dated Oct. 19, 2018.
Office Action from Russian Application No. 2017111509/12 dated Oct. 19, 2018.
Office Action from Chinese Application No. 201611040895.7 dated Nov. 5, 2018.
Office Action from Chinese Application No. 201611040895.7 dated Jul. 2, 2019.
Office Action from Australian Application No. 2016409528 dated Jun. 26, 2019.
Office Action from Russian Application No. 2017111509/12 dated May 24, 2018.
Search Report from Russian Application No. 2017111509/12 dated May 24, 2018.
Examination report from Australian Application No. 2016409528 dated Nov. 15, 2019.
Examination Report from New Zealand Application No. 738539 dated Feb. 24, 2020.
Examination Report from New Zealand Application No. 738539 dated Jan. 21, 2020.
Examination Report from New Zealand Application No. 738539 dated Nov. 4, 2019.
Examination Report from Pakistan Application No. 550/2017 dated Mar. 28, 2019.
Office Action from Chinese Application No. 2016110408957 dated Jan. 15, 2020.
Office Action from Colombian Application No. NC2018/0005437 dated Jan. 12, 2020.
Office Action from European Application No. 16 840 288.1 dated May 8, 2020.
Office Action from Indonesian Patent Application No. P00201709795 dated Apr. 1, 2020.
Office Action from Japanese Application No. 2017-556729 dated Mar. 26, 2020.

* cited by examiner

AIR CONDITIONER AND METHOD FOR SELF-CLEANING AIR CONDITIONER HEAT EXCHANGER

The present application is a Continuation-in-Part of International Application No. PCT/CN2016/108395, filed Dec. 2, 2016, designating the United States, and claiming the benefit of Chinese Patent Application No. 201611040895.7, filed with the Chinese Patent Office on Nov. 11, 2016 and entitled "self-cleaning method for air-conditioner heat exchanger", which are hereby incorporated by reference in their entireties.

TECHNICAL FIELD

The present invention relates to the field of air-conditioner technologies, and specifically, to a self-cleaning method for an air-conditioner heat exchanger.

BACKGROUND

To ensure sufficient heat exchange of an air-conditioner, generally, a fin of an air-conditioner heat exchanger is designed into compact multi-layer pieces, and a gap between pieces is only 1-2 mm, and various press molds or cracks are added into the fin of the air-conditioner to enlarge a heat exchange area. During operation of the air-conditioner, a large amount of air circulates; the heat exchanger exchanges heat; various dust, impurities, and the like in air are attached to the heat exchanger, which not only affects the effect of the heat exchanger, but also easily causes bacteria breezing, and consequently, the air-conditioner generates peculiar smell and even user health is affected. At the moment, the air-conditioner heat exchanger needs to be cleaned. However, because the shape of the heat exchanger is complex, cleaning on the heat exchanger is inconvenient.

SUMMARY

An objective of the present invention is to provide a self-cleaning method for an air-conditioner heat exchanger, so that self-cleaning can be performed on an air-conditioner heat exchanger conveniently. The self-cleaning effect is good, and the cleaning efficiency is high.

According to one aspect of the present invention, a self-cleaning method for an air-conditioner heat exchanger is provided, comprising:

controlling an air-conditioner to enter a self-cleaning mode;

detecting an ambient temperature of a to-be-cleaned heat exchanger, and determining, according to the detected ambient temperature, a target evaporating temperature of the to-be-cleaned heat exchanger;

adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost; and after a surface of the to-be-cleaned heat exchanger is covered with a frost layer or an ice layer, controlling the air conditioner to enter a defrosting mode of the to-be-cleaned heat exchanger.

Preferably, the target evaporating temperature is determined by means of the following formula:

$T0=k*T-A$ or $T0=T1$, taking a smaller one of them, wherein k is a calculating coefficient, and a value thereof is 0.7-1; A is a temperature compensation value, and a value thereof is 4-25° C.; T is the ambient temperature of the to-be-cleaned heat exchanger; $-10° C. \leq T1 < 0° C.$ Preferably, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises:

comparing a relationship between the target evaporating temperature and the actual evaporating temperature; and adjusting an operating frequency of a compressor according to a comparison result.

Preferably, the step of adjusting an operating frequency of a compressor according to a comparison result comprises:

when $Te > T0+B2$, improving the operating frequency of the compressor;

when $Te < T0-B1$, reducing the operating frequency of the compressor; and when $T0-B1 \leq Te \leq T0+B2$, keeping current operating state, wherein a value of B1 is 1-20° C. and a value of B2 is 1-10° C.

Preferably, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises:

comparing a relationship between the target evaporating temperature and the actual evaporating temperature; and adjusting, according to a comparison result, a rotation speed of a fan corresponding to the to-be-cleaned heat exchanger.

Preferably, the step of adjusting, according to a comparison result, a rotation speed of a fan corresponding to the to-be-cleaned heat exchanger comprises:

when $Te > T0+B2$, reducing the rotation speed of the fan;

when $Te < T0-B1$, improving the rotation speed of the fan; and when $T0-B1 \leq Te \leq T0+B2$, keeping current operating state, wherein a value of B1 is 1-20° C. and a value of B2 is 1-10° C.

Preferably, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises:

comparing a relationship between the target evaporating temperature and the actual evaporating temperature; and adjusting, according to a comparison result, a refrigerant flow that flows through the to-be-cleaned heat exchanger.

Preferably, the step of adjusting, according to a comparison result, a refrigerant flow that flows through the to-be-cleaned heat exchanger comprises:

when $Te > T0+B2$, reducing the refrigerant flow;

when $Te < T0-B1$, increasing the refrigerant flow; and when $T0-B1 \leq Te \leq T0+B2$, keeping current operating state, wherein a value of B1 is 1-20° C. and a value of B2 is 1-10° C.

Preferably, the step of controlling the to-be-cleaned heat exchanger to frost comprises:

when it is detected that $Te < T0+C$, controlling the to-be-cleaned heat exchanger to operate frosting for time of t1, and then controlling the to-be-cleaned heat exchanger to operate defrosting.

Preferably, after the to-be-cleaned heat exchanger operates frosting for time of t2, and $Te < T0+C$ still cannot be satisfied, a fan corresponding to the to-be-cleaned heat exchanger is controlled to stop operation for time of t3, and the fan corresponding to the to-be-cleaned heat exchanger is restarted to enter the defrosting mode until Te<T0 and time of t4 is kept.

According to another aspect of the present invention, an air-conditioner is provided, comprising a memory and one or more processors, a multiple temperature sensor, wherein the memory stores therein computer readable program codes, the temperature sensor detects an ambient temperature of a to-be-cleaned heat exchanger, and the one or more processors are configured to execute the computer readable program codes:

to control the air-conditioner to enter a self-cleaning mode;

to determine according to the detected ambient temperature, a target evaporating temperature of the to-be-cleaned heat exchanger;

to adjust according to the target evaporating temperature and an actual evaporating temperature of the to-be-cleaned heat exchanger, an evaporating temperature of the to-be-cleaned heat exchanger, and controlling the to-be-cleaned heat exchanger to frost; and after a surface of the to-be-cleaned heat exchanger is covered with a frost layer or an ice layer, to control the air conditioner to enter a defrosting mode of the to-be-cleaned heat exchanger.

According to another aspect of the present invention, a self-cleaning method for an air-conditioner heat exchanger is provided, comprising:

controlling, by a processor of an air-conditioner, the air-conditioner to enter a self-cleaning mode;

detecting, by a temperature sensor of the air-conditioner, an ambient temperature of a to-be-cleaned heat exchanger, and determining, by the processor, according to the detected ambient temperature, a target evaporating temperature of the to-be-cleaned heat exchanger;

adjusting, by the processor, according to the target evaporating temperature and an actual evaporating temperature of the to-be-cleaned heat exchanger, an evaporating temperature of the to-be-cleaned heat exchanger, and controlling, by the processor, the to-be-cleaned heat exchanger to frost; and after a surface of the to-be-cleaned heat exchanger is covered with a frost layer or an ice layer, controlling, by the processor, the air conditioner to enter a defrosting mode of the to-be-cleaned heat exchanger.

The self-cleaning method for an air-conditioner heat exchanger of the present embodiments comprises: controlling an air-conditioner to enter a self-cleaning mode; detecting an ambient temperature of a to-be-cleaned heat exchanger, and determining, according to the detected ambient temperature, a target evaporating temperature of the to-be-cleaned heat exchanger; adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost; and after a surface of the to-be-cleaned heat exchanger is covered with a frost layer or an ice layer, controlling the air conditioner to enter a defrosting mode of the to-be-cleaned heat exchanger. According to the foregoing self-cleaning method, an evaporating temperature of a to-be-cleaned heat exchanger can be adjusted according to a difference between a target evaporating temperature and an actual evaporating temperature of the to-be-cleaned heat exchanger, so that a surface of the to-be-cleaned heat exchanger can frost or freeze, and therefore dust, impurities, and the like on the surface of the to-be-cleaned heat exchanger are peeled off from the surface of the to-be-cleaned heat exchanger by a frost layer or an ice layer, and are removed from the to-be-cleaned heat exchanger after defrosting; the cleaning effect is good and the cleaning efficiency is high, and the self-cleaning method is not limited by a shape and a structure of the to-be-cleaned heat exchanger; the cleaning effect is more thorough and effective, and not only bacteria breeding can be prevented, but also the heat change efficiency of the to-be-cleaned heat exchanger can be improved.

It should be understood that the foregoing general description and subsequent detail description are merely exemplary and explanatory and cannot limit the present invention.

BRIEF DESCRIPTION OF THE DRAWINGS

The accompanying drawing herein is incorporated into the specification and forms a part of the present specification, shows embodiments that satisfy the present invention, and is used, together with the specification, principles of the present specification.

DETAILED DESCRIPTION

The following descriptions and accompanying drawings sufficiently show specific implementation solutions of the present invention, so that a person skilled in the art can practice them. Other implementation solutions may comprise structural, logical, electrical, procedural, and other changes. Embodiments represent only possible changes. Unless otherwise definitely required, individual components and functions are optional, and an operating sequence can be changed. Parts and features of some implementation solutions may be incorporated in or replace parts and features of other implementation solutions. The scope of the implementation solutions of the present invention comprises the entire scope of the claims, and all obtainable equivalents of the claims. In the present specification, each implementation solution can be individually or generally indicated by a term "invention" simply for convenience, and if in fact, more than one invention is disclosed, the application scope is not automatically limited as any individual invention or inventive concept. In the present specification, for example, relationship terms such as a first level and a second level are used merely to distinguish one entity or operation from another entity or operation, and are not intended to require or imply that any actual relationship or sequence exists belong the entities or operations. In addition, term "comprise", "include", or any other variant thereof aims to cover non-exclusive "include", so that a process, method, or device that comprises a series of elements not only comprises the elements, but also comprises other elements that are not definitely listed, or further comprises inherent elements of the process, method, or device. In a case in which there are no more limitations, an element defined by the sentence "comprise a . . . " does not exclude the case in which other same elements further exist in a process, method, or device that comprises the element. Each embodiment of the present specification is described in a progressive manner, and each embodiment mainly describes differences from other embodiments, and refer to each other for same or similar parts between the embodiments. Because products disclosed in embodiments correspond to the method part disclosed in the embodiments, the products are simply described, and refer to the description of the method part for relevant products.

Figure 3:
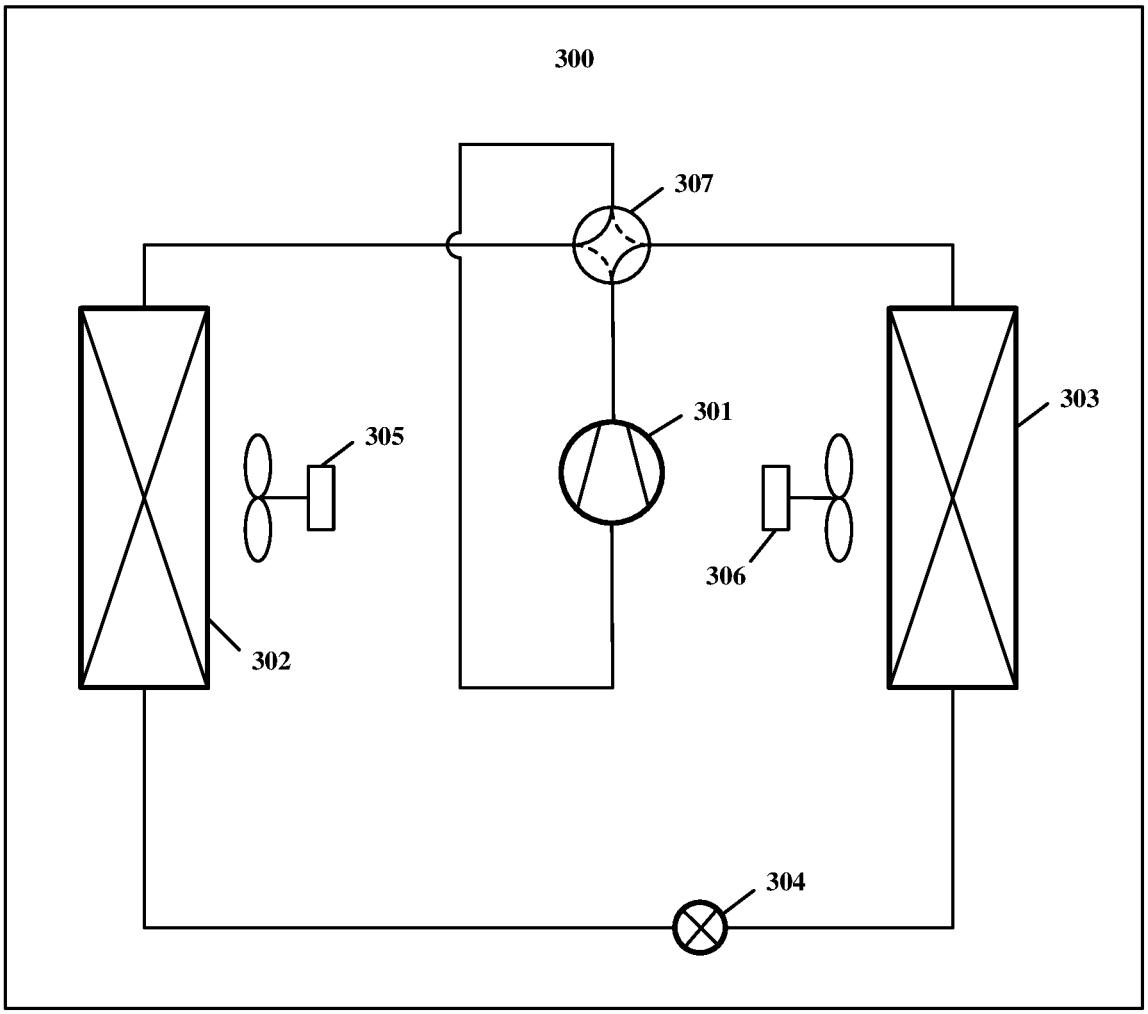
FIG. 3 is a structural illustration of an air conditioner applied in a self-cleaning method for an air-conditioner heat exchanger of an embodiment of the present invention.

As shown in FIG. 3, an air-conditioner 300 adapted to a self-cleaning method of the present invention includes a compressor 301, an indoor heat exchanger 302, an outdoor heat exchanger 303, a throttling device 304, a first fan 305 and a second fan 306. The first fan 305 is a fan corresponding to the indoor heat exchanger 302, and the second fan 306 is a fan corresponding to the outdoor heat exchanger 303, and the adapted air-conditioner may also comprise a four-way valve 307, which is unnecessary. The air-conditioner may also comprise multiple temperature sensors, configured to detect an indoor heat exchanger temperature, an indoor ambient temperature, an outdoor heat exchanger temperature, and an outdoor ambient temperature.

Figure 1:
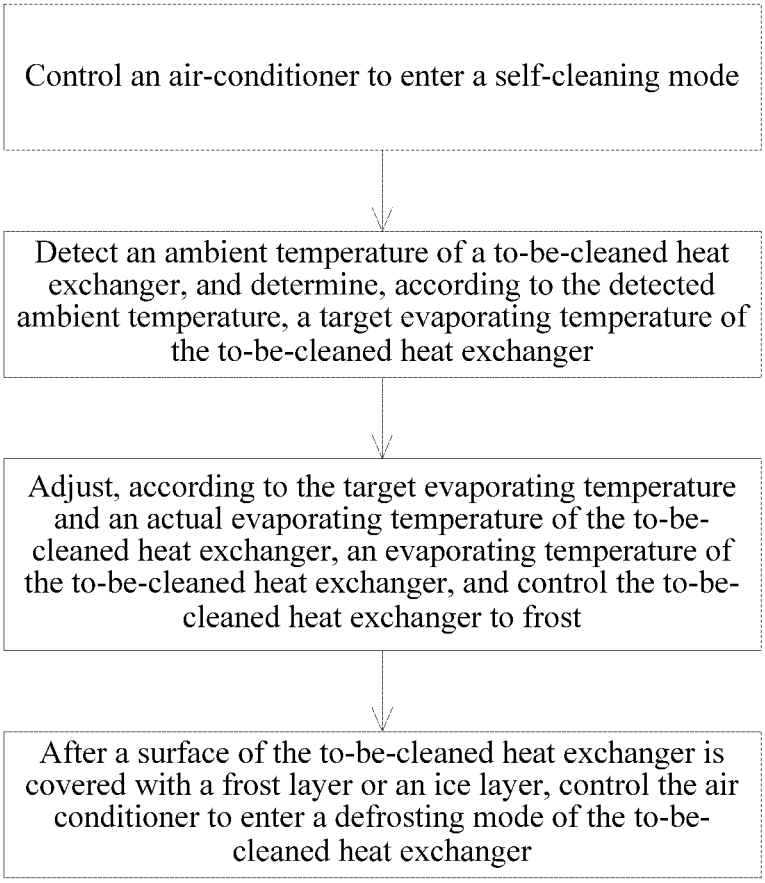
FIG. 1 is a flowchart of a self-cleaning method for an air-conditioner heat exchanger of an embodiment of the present invention.

As shown in FIG. 1, according to an embodiment of the present invention, a self-cleaning method for an air-conditioner heat exchanger includes: controlling an air-conditioner to enter a self-cleaning mode; detecting an ambient temperature of a to-be-cleaned heat exchanger, and determining, according to the detected ambient temperature, a target evaporating temperature of the to-be-cleaned heat exchanger; adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost; and after a surface of the to-be-cleaned heat exchanger is covered with a frost layer or an ice layer, controlling the air conditioner to enter a defrosting mode of the to-be-cleaned heat exchanger.

When the evaporating temperature of the to-be-cleaned heat exchanger is adjusted according to the target evaporating temperature and the actual evaporating temperature of the to-be-cleaned heat exchanger, and the to-be-cleaned heat exchanger is controlled to frost, operating parameters of the air-conditioner, for example, an operating frequency of a compressor, a rotation speed of a fan corresponding to the to-be-cleaned heat exchanger, and a refrigerant flow of the to-be-cleaned heat exchanger may be adjusted; the parameters may be individually adjusted, adjusted in pairs, or adjusted in a linkage manner together. A specific adjusting manner may be selected according to the detected evaporating temperature and the set target evaporating temperature.

According to the foregoing self-cleaning method, an evaporating temperature of a to-be-cleaned heat exchanger can be adjusted according to a difference between a target evaporating temperature and an actual evaporating temperature of the to-be-cleaned heat exchanger, so that a surface of the to-be-cleaned heat exchanger can frost or freeze, and therefore dust, impurities, and the like on the surface of the to-be-cleaned heat exchanger are peeled off from the surface of the to-be-cleaned heat exchanger by a frost layer or an ice layer, and are removed from the to-be-cleaned heat exchanger after defrosting; the cleaning effect is good and the cleaning efficiency is high, and the self-cleaning method is not limited by a shape and a structure of the to-be-cleaned heat exchanger; the cleaning effect is more thorough and effective, and not only bacteria breeding can be prevented, but also the heat change efficiency of the to-be-cleaned heat exchanger can be improved.

The target evaporating temperature is determined by means of the following formula:

$T0=k*T-A$ or $T0=T1$, taking a smaller one of them, wherein k is a calculating coefficient, and a value thereof is 0.7-1; A is a temperature compensation value, and a value thereof is 4-25° C.; T is the ambient temperature of the to-be-cleaned heat exchanger; $-10° C. \leq T1 < 0° C$. Preferably, k is 0.9, A is 18° C., and T1 is −5° C.

For example, when the ambient temperature is 36° C., a value of k is 0.7, a value of T1 is −5° C., and the value of A is 25° C., because a value of T0 is obtained as 0.2° C. by using the formula T0=k*T−A, and when the value of T0 is T1, T0 is −5° C., and at the moment, T0 is −5° C.

When the ambient temperature is 25° C., the value of k is 0.7, the value of T1 is −5° C., and the value of A is 25° C., because the value of T0 is obtained as −7.5° C. by using the formula T0=k*T−A, and when the value of T0 is T1, T0 is −5° C., and at the moment, T0 is −7.5° C.

By means of the foregoing formula, a temperature value relevant with the ambient temperature may be selected when the ambient temperature is in a reasonable range; when the ambient temperature is excessively high, a temperature value that can satisfy a frosting requirement of the to-be-cleaned heat exchanger is selected, to ensure smooth process of self-cleaning of the to-be-cleaned heat exchanger, and the air-conditioner can select a reasonable evaporating temperature according to the ambient temperature when the ambient temperature is in a reasonable range, so as to ensure working efficiency of the air-conditioner.

Certainly, the target evaporating temperature may also be reasonably determined in other manners, to ensure smooth completion of self-cleaning of the to-be-cleaned heat exchanger.

When the operating frequency of the compressor is selected as an adjusting parameter during self-cleaning of the air-conditioner, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises: comparing a relationship between the target evaporating temperature and the actual evaporating temperature; and adjusting an operating frequency of a compressor according to a comparison result.

The step of adjusting an operating frequency of a compressor according to a comparison result specifically comprises: when $Te > T0+B2$, improving the operating frequency of the compressor; when $Te < T0-B1$, reducing the operating frequency of the compressor; and when $T0-B1 \leq Te \leq T0+B2$, keeping current operating state, wherein a value of B1 is 1-20° C. and a value of B2 is 1-10° C.

By adjusting the operating frequency of the compressor when the heat exchanger is in a cleaning mode, the evaporating temperature of the heat exchanger can be controlled to be in a suitable frosting temperature range, so that a surface of the heat exchanger can frost quickly and uniformly; dirt is peeled off the surface of the heat exchanger by means of an acting force of frosting solidification, and then the surface of the heat exchanger is cleaned in a defrosting manner, so as to effectively improve the cleaning effect of the surface of the heat exchanger.

To ensure reliable operation of an air-conditioner system, it should be generally ensured that $T0-B1 \geq -30°$ C. and $T0+B2 \leq -5°$ C., so that the evaporating temperature of the to-be-cleaned heat exchanger is always kept within a suitable range, to ensure sufficient frosting or freezing on the surface of the to-be-cleaned heat exchanger, excessively high energy consumption of the air-conditioner may be prevented, to improve working efficiency of the air-conditioner.

When Te>T0+B2, the step of improving the operating frequency of the compressor comprises: when T0+B2<Te≤T0+B3, improving the operating frequency of the compressor according to a rate of a Hz/s; and when Te>T0+B3, improving the operating frequency of the compressor according to a rate of b Hz/s, wherein B3>B2 and a<b.

When Te>T0+B2, it indicates that the current evaporating temperature of the to-be-cleaned heat exchanger is excessively high, which is not good for surface frosting of the to-be-cleaned heat exchanger, and the evaporating temperature of the to-be-cleaned heat exchanger needs to be reduced, and therefore, the operating frequency of the compressor needs to be improved, the heat exchange capability of the to-be-cleaned heat exchanger needs to be improved, and the evaporating temperature of the to-be-cleaned heat exchanger needs to be reduced.

During specific adjustment, if T0+B2<Te≤T0+B3, it indicates that the evaporating temperature of the to-be-cleaned heat exchanger is higher than the target evaporating temperature by a small amplitude, and therefore the operating frequency of the compressor may be improved at a low rate. On one aspect, it can be ensured that the evaporating temperature of the to-be-cleaned heat exchanger approaches to the target evaporating temperature, and on the other aspect, unstable operation of the air-conditioner caused by excessively quick adjustment of the operating frequency of the compressor can also be avoided to improve working efficiency of the air-conditioner.

If Te>T0+B3, it indicates that the evaporating temperature of the to-be-cleaned heat exchanger is higher than the target evaporating temperature by a large amplitude, and the operating frequency of the compressor needs to be improved at a high rate, so that the evaporating temperature of the to-be-cleaned heat exchanger reaches the target evaporating temperature quickly, so as to improve the surface frosting or freezing efficiency of the to-be-cleaned heat exchanger, thereby improving the self-cleaning efficiency of the air-conditioner.

In the foregoing manner, a suitable manner for adjusting the operating frequency of the compressor may be selected according to working conditions of the air-conditioner, so that not only quick adjustment on the evaporating temperature of the to-be-cleaned heat exchanger is ensured, but also excessively large fluctuation on the operation of the air-conditioner is avoided.

When Te>T0+B2, the operating frequency of the compressor may also be improved in the following manner: when T0+B2<Te≤T0+B3, improving the operating frequency of the compressor according to a rate of (a−ct) Hz/s; and when Te>T0+B3, improving the operating frequency of the compressor according to a rate of (b−dt) Hz/s.

Because in a process of adjusting the operating frequency of the compressor, an adjusting amplitude need of the operating frequency of the compressor gradually decreases with the reduction of the operating frequency of the compressor; if the adjusting amplitude of the operating frequency of the compressor keeps unchanged, adjusting accuracy of the operating frequency of the compressor gradually decreases, and energy consumption of the compressor does not reach optimal state. Therefore, variable rate adjustment may be performed on the operating frequency of the compressor in the foregoing manner, so as to ensure that the operating frequency of the compressor can match the operating frequency that needs to be adjusted of the compressor, so that the compressor can operate with high efficiency and power consumption of the compressor is reduced, thereby improving adjusting accuracy of the operating frequency of the compressor.

When Te<T0−B1, the step of reducing the operating frequency of the compressor comprises: when T0−B4≤Te<T0−B1, reducing the operating frequency of the compressor according to a rate of a Hz/s; and when Te<T0−B4, reducing the operating frequency of the compressor according to a rate of b Hz/s, wherein B4>B1 and a<b.

When Te<T0−B1, it indicates that the current evaporating temperature of the to-be-cleaned heat exchanger is excessively low, which causes non-uniform surface frosting of the to-be-cleaned heat exchanger, and causes great reduction of working efficiency of the air-conditioner at the same time; the evaporating temperature of the to-be-cleaned heat exchanger needs to be improved, and therefore, the operating frequency of the compressor needs to be reduced, the heat exchange capability of the to-be-cleaned heat exchanger needs to be reduced, and the evaporating temperature of the to-be-cleaned heat exchanger needs to be improved.

During specific adjustment, if T0−B4≤Te<T0−B1, it indicates that a difference between the evaporating temperature of the to-be-cleaned heat exchanger and the target evaporating temperature is small, and therefore the operating frequency of the compressor may be reduced at a low rate. On one aspect, it can be ensured that the evaporating temperature of the to-be-cleaned heat exchanger approaches to the target evaporating temperature, and on the other aspect, unstable operation of the air-conditioner caused by excessively quick adjustment of the operating frequency of the compressor can also be avoided to improve working efficiency of the air-conditioner.

If Te<T0−B4, it indicates that the difference between the evaporating temperature of the to-be-cleaned heat exchanger and the target evaporating temperature is large, and the operating frequency of the compressor needs to be reduced at a high rate, so that the evaporating temperature of the to-be-cleaned heat exchanger reaches the target evaporating temperature quickly, so as to improve the surface frosting or freezing efficiency of the to-be-cleaned heat exchanger, thereby improving the self-cleaning efficiency of the air-conditioner.

In the foregoing manner, a suitable manner for adjusting the operating frequency of the compressor may be selected according to working conditions of the air-conditioner, so that not only quick adjustment on the evaporating temperature of the to-be-cleaned heat exchanger is ensured, but also excessively large fluctuation on the operation of the air-conditioner is avoided.

When Te<T0−B1, the operating frequency of the compressor may also be reduced in the following manner: when T0−B4≤Te<T0−B1, reducing the operating frequency of the compressor according to a rate of (a−ct) Hz/s; and when Te<T0−B4, reducing the operating frequency of the compressor according to a rate of (b−dt) Hz/s.

Because in a process of adjusting the operating frequency of the compressor, an adjusting amplitude need of the operating frequency of the compressor gradually decreases with the reduction of the operating frequency of the compressor; if the adjusting amplitude of the operating frequency of the compressor keeps unchanged, adjusting accuracy of the operating frequency of the compressor gradually decreases, and energy consumption of the compressor does not reach optimal state. Therefore, variable rate adjustment may be performed on the operating frequency of the compressor in the foregoing manner, so as to ensure that the operating frequency of the compressor can match the operating frequency that needs to be adjusted of the compressor, so that the compressor can operate with high efficiency and power consumption of the compressor is reduced, thereby improving adjusting accuracy of the operating frequency of the compressor.

After the heat exchanger of the air-conditioner enters the self-cleaning mode, a fan on a self-cleaning side is started, and continuously provides moist air to the heat exchanger, so that the surface of the heat exchanger is covered by a water film; at the moment, the fan on the self-cleaning side stops operation, the evaporating temperature (namely, a heat exchanger coil temperature) decreases quickly, the water film on the surface of the heat exchanger freezes, and water that condenses in air frosts, so as to peel off dirt on the heat exchanger. To achieve a quickest frosting effect, the compressor needs to operate at a highest operating frequency within a reliability ensured range during operation; in a frosting process, a larger temperature difference indicates a quicker frosting speed, and therefore a higher frequency of the compressor indicates a better effect. However, at the same time, because the fan stops at the moment, a heat exchange amount of the heat exchanger is extremely small, and the evaporating temperature decreases quickly, the reliability of the compressor is affected. Therefore, to make the frosting speed of the heat exchanger and the operation reliability of the compressor reach a good balance, the evaporating temperature needs to be controlled within a particular range. Upon experimental test, the frosting effect and operation reliability of the entire machine can be well ensured within a temperature range of $-20° C. \leq Te \leq -15° C.$ Therefore, during frequency adjustment of the compressor, the evaporating temperature of the heat exchanger should be controlled within the evaporating temperature range.

By using that $-20° C. \leq Te \leq -15° C.$ is the evaporating temperature range of the to-be-cleaned heat exchanger as an example, the specific process of adjusting the operating frequency of the compressor is described below:

when it is detected that the evaporating temperature satisfies $Te < -20° C.$, the compressor is controlled to reduce the frequency;

when it is detected that the evaporating temperature satisfies $-20° C. \leq Te \leq -15° C.$, the current operating frequency of the compressor is kept; and when it is detected that the evaporating temperature satisfies $-15° C. < Te$, the compressor is controlled to improve the frequency.

When it is detected that $Te < -20° C.$, it indicates that the evaporating temperature is excessively low, and consequently, operation reliability of the compressor is reduced, and therefore the compressor needs to be controlled to reduce the frequency to reduce a heat exchange amount of the heat exchanger, and improve the evaporating temperature of the heat exchanger, thereby improving the reliability during operation of the compressor.

When it is detected that $-20° C. \leq Te \leq -15° C.$, it indicates that the current evaporating temperature not only can ensure frosting efficiency of the surface of the heat exchanger, but also can ensure the reliability of operation of the compressor, and therefore the compressor can be made to keep the current operating frequency, so that the air-conditioner has a high energy efficiency ratio.

When it is detected that $-15° C. < Te$, it indicates that the evaporating temperature is excessively high, and consequently, frosting efficiency of the surface of the heat exchanger is obviously reduced, and therefore the compressor needs to be controlled to improve the frequency to improve heat exchange efficiency of the heat exchanger, thereby improving the frosting efficiency of the surface of the heat exchanger.

When $Te < -20° C.$, if it is detected that the evaporating temperature satisfies $Te < -25° C.$, the compressor is controlled to quickly reduce the frequency at 1 Hz/s; and if it is detected that the evaporating temperature satisfies $-25° C. \leq Te < -20° C.$, the compressor is controlled to slowly reduce the frequency at 1 Hz/10 s. a is 1 Hz/10 s and b is 1 Hz/s.

When it is detected that $Te < -25° C.$, it indicates that a temperature difference between the evaporating temperature and the evaporating temperature that needs to be adjusted is large, and therefore the operating frequency of the compressor needs to be quickly reduced, so that the evaporating temperature is quickly improved, thereby preventing the compressor from operating in unreliable state.

When it is detected that $-25° C. \leq Te \leq -20° C.$, it indicates that the temperature difference between the evaporating temperature and the evaporating temperature that needs to be adjusted is small, and therefore the operating frequency of the compressor may be slowly reduced, so that the evaporating temperature can be adjusted towards an evaporating temperature range that ensures the frosting effect and the operation reliability of the entire machine, thereby avoiding excessively quick evaporating temperature adjustment.

The foregoing frequency reduction rate may be another value, as long as it is ensured that b is greater than a.

When it is detected that the evaporating temperature satisfies $-15° C. < Te \leq -10° C.$, the compressor is controlled to slowly improve the frequency at 1 Hz/10 s; and when it is detected that the evaporating temperature satisfies $-10° C. < Te$, the compressor is controlled to quickly improve the frequency at 1 Hz/s, wherein a is 1 Hz/10 s and b is 1 Hz/s.

When it is detected that $-15° C. < Te \leq -10° C.$, it indicates that the temperature difference between the evaporating temperature and the evaporating temperature that needs to be adjusted is small, and therefore the operating frequency of the compressor may be slowly improved, so that the evaporating temperature can be adjusted towards an evaporating temperature range that ensures the frosting effect and the operation reliability of the entire machine, thereby avoiding excessively quick evaporating temperature adjustment.

When it is detected that $-10° C. < Te$, it indicates that the temperature difference between the evaporating temperature and the evaporating temperature that needs to be adjusted is large, and therefore the operating frequency of the compressor needs to be quickly improved, so that the evaporating temperature is quickly improved, thereby preventing the compressor from operating in unreliable state.

The frequency adjustment of the compressor may also be performed in the following manner, for example:

when $Te < -20° C.$, if it is detected that the evaporating temperature satisfies $Te < -25° C.$, the compressor is controlled to quickly reduce the frequency at $(1-0.1t)$ Hz/s;

if it is detected that the evaporating temperature satisfies $-25° C. \leq Te < -20° C.$, the compressor is controlled to slowly reduce the frequency at $(1-0.1t)$Hz/10 s;

when it is detected that the evaporating temperature satisfies −15° C.<Te≤−10° C., the compressor is controlled to slowly improve the frequency at (1−0.1t)Hz/10 s; and when it is detected that the evaporating temperature satisfies −10° C.<Te, the compressor is controlled to quickly improve the frequency at (1−0.1t) Hz/s.

A is 1 Hz/10 s, b is 1 Hz/s, c is 0.01 Hz/s, d is 0.1 Hz/s, and t is the adjusting time of the operating frequency of the compressor and a unit thereof is s.

The foregoing values may be set according to adjusting requirements of the compressor, so as to adjust a frequency adjusting speed of the compressor, so that the compressor can operate with high efficiency, and the reliability and stability of operation of the compressor can be ensured.

When the rotation speed of the fan is selected as an adjusting parameter during self-cleaning of the air-conditioner, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises: comparing a relationship between the target evaporating temperature and the actual evaporating temperature; and adjusting, according to a comparison result, a rotation speed of a fan corresponding to the to-be-cleaned heat exchanger.

The step of adjusting, according to a comparison result, a rotation speed of a fan corresponding to the to-be-cleaned heat exchanger specifically comprises: when Te>T0+B2, reducing the rotation speed of the fan; when Te<T0−B1, improving the rotation speed of the fan; and when T0−B1≤Te≤T0+B2, keeping current operating state, wherein a value of B1 is 1-20° C. and a value of B2 is 1-10° C.

By adjusting the rotation speed of the fan corresponding to the to-be-cleaned heat exchanger when the heat exchanger is in a cleaning mode, the evaporating temperature of the heat exchanger can be controlled to be in a suitable frosting temperature range, so that a surface of the heat exchanger can frost quickly and uniformly; dirt is peeled off the surface of the heat exchanger by means of an acting force of frosting solidification, and then the surface of the heat exchanger is cleaned in a defrosting manner, so as to effectively improve the cleaning effect of the surface of the heat exchanger.

When Te>T0+B2, the step of reducing the rotation speed of the fan comprises: when T0+B2<Te≤T0+B3, reducing the rotation speed of the fan according to a rate of a1 r/min; and when Te>T0+B3, reducing the rotation speed of the fan according to a rate of b1 r/min, wherein B3>B2 and a1<b1. a1 herein, for example, is 50 r/min, and b1, for example, is 100 r/min. T0+B3 herein, for example, is −10° C., and T0+B2, for example, is −15° C.

When Te>T0+B2, it indicates that the current evaporating temperature of the to-be-cleaned heat exchanger is excessively high, which is not good for surface frosting of the to-be-cleaned heat exchanger, and the evaporating temperature of the to-be-cleaned heat exchanger needs to be reduced, and therefore, the rotation speed of the fan needs to be reduced, the heat exchange capability of the surface of the to-be-cleaned heat exchanger needs to be reduced, so that an air flowing speed of the surface of the to-be-cleaned heat exchanger slows and cooling capacity can accumulate, so as to reduce the evaporating temperature of the to-be-cleaned heat exchanger.

During specific adjustment, if T0+B2<Te≤T0+B3, it indicates that the evaporating temperature of the to-be-cleaned heat exchanger is higher than the target evaporating temperature by a small amplitude, and therefore the rotation speed of the fan may be reduced at a low rate. On one aspect, it can be ensured that the evaporating temperature of the to-be-cleaned heat exchanger approaches to the target evaporating temperature, and on the other aspect, unstable operation of the air-conditioner caused by excessively quick adjustment of the rotation speed of the fan can also be avoided to improve working efficiency of the air-conditioner.

If Te>T0+B3, it indicates that the evaporating temperature of the to-be-cleaned heat exchanger is higher than the target evaporating temperature by a large amplitude, and the rotation speed of the fan needs to be reduced at a high rate, so that the evaporating temperature of the to-be-cleaned heat exchanger reaches the target evaporating temperature quickly, so as to improve the surface frosting or freezing efficiency of the to-be-cleaned heat exchanger, thereby improving the self-cleaning efficiency of the air-conditioner.

In the foregoing manner, a suitable manner for adjusting the rotation speed of the fan may be selected according to working conditions of the air-conditioner, so that not only quick adjustment on the evaporating temperature of the to-be-cleaned heat exchanger is ensured, but also excessively large fluctuation on the operation of the air-conditioner is avoided.

When Te>T0+B2, the rotation speed of the fan may also be reduced in the following manner: when T0+B2<Te≤T0+B3, reducing the rotation speed of the fan according to a rate of (a1−c1t) r/min; and when Te>T0+B3, reducing the rotation speed of the fan according to a rate of (b1−d1t) r/min. a1, for example, is 50 r/min; b1, for example, is 100 r/min; c1, for example, is 5 r/min; d1, for example, is 10 r/min, and t is the adjusting time of the rotation speed of the fan and a unit thereof is s.

Because in a process of adjusting the rotation speed of the fan, an adjusting amplitude need of the rotation speed of the fan gradually decreases with the reduction of the rotation speed of the fan; if the adjusting amplitude of the rotation speed of the fan keeps unchanged, adjusting accuracy of the rotation speed of the fan gradually decreases, and energy consumption of the compressor does not reach optimal state. Therefore, variable rate adjustment may be performed on the rotation speed of the fan in the foregoing manner, so as to ensure that the rotation speed of the fan can match the rotation speed that needs to be adjusted of the fan, so that the compressor can operate with high efficiency and power consumption of the compressor is reduced, thereby improving adjusting accuracy of the rotation speed of the fan.

When Te<T0−B1, the step of improving the rotation speed of the fan comprises: when T0−B4≤Te<T0−B1, improving the rotation speed of the fan according to a rate of a1 r/min; and when Te<T0−B4, improving the rotation speed of the fan according to a rate of b1 r/min, wherein B4>B1, a<b, T0−B4=−25° C., T0−B1=−20° C.; a1, for example, is 50 r/min, and b1, for example, is 100 r/min.

When Te<T0−B1, it indicates that the current evaporating temperature of the to-be-cleaned heat exchanger is excessively low, which causes non-uniform surface frosting of the to-be-cleaned heat exchanger, and causes great reduction of working efficiency of the air-conditioner at the same time; the evaporating temperature of the to-be-cleaned heat exchanger needs to be improved, and therefore, the rotation speed of the fan needs to be improved, so that the air flowing speed of the surface of the to-be-cleaned heat exchanger accelerates, and a speed for exchanging heat with indoor air accelerates, to improve exchange capability of the to-be-cleaned heat exchanger, and improve the evaporating temperature of the to-be-cleaned heat exchanger.

During specific adjustment, if T0−B4≤Te<T0−B1, it indicates that a difference between the evaporating temperature of the to-be-cleaned heat exchanger and the target evaporating temperature is small, and therefore the rotation speed of the fan may be improved at a low rate. On one aspect, it can be ensured that the evaporating temperature of the to-be-cleaned heat exchanger approaches to the target evaporating temperature, and on the other aspect, unstable operation of the air-conditioner caused by excessively quick adjustment of the rotation speed of the fan can also be avoided to improve working efficiency of the air-conditioner.

If Te<T0−B4, it indicates that the difference between the evaporating temperature of the to-be-cleaned heat exchanger and the target evaporating temperature is large, and the rotation speed of the fan needs to be improved at a high rate, so that the evaporating temperature of the to-be-cleaned heat exchanger reaches the target evaporating temperature quickly, so as to improve the surface frosting or freezing efficiency of the to-be-cleaned heat exchanger, thereby improving the self-cleaning efficiency of the air-conditioner.

In the foregoing manner, a suitable manner for adjusting the rotation speed of the fan may be selected according to working conditions of the air-conditioner, so that not only quick adjustment on the evaporating temperature of the to-be-cleaned heat exchanger is ensured, but also excessively large fluctuation on the operation of the air-conditioner is avoided.

When Te<T0−B1, the rotation speed of the fan may also be improved in the following manner: when T0−B4≤Te<T0−B1, improving the rotation speed of the fan according to a rate of (a1−c1t) r/min; and when Te<T0−B4, improving the rotation speed of the fan according to a rate of (b1−d1t) r/min. a1, for example, is 50 r/min; b1, for example, is 100 r/min; c1, for example, is 5 r/min; d1, for example, is 10 r/min, and t is the adjusting time of the rotation speed of the fan and a unit thereof is s.

Because in a process of adjusting the rotation speed of the fan, an adjusting amplitude need of the rotation speed of the fan gradually decreases with the reduction of the rotation speed of the fan; if the adjusting amplitude of the rotation speed of the fan keeps unchanged, adjusting accuracy of the rotation speed of the fan gradually decreases, and energy consumption of the compressor does not reach optimal state. Therefore, variable rate adjustment may be performed on the rotation speed of the fan in the foregoing manner, so as to ensure that the rotation speed of the fan can match the rotation speed that needs to be adjusted of the fan, so that the compressor can operate with high efficiency and power consumption of the compressor is reduced, thereby improving adjusting accuracy of the rotation speed of the fan.

When the refrigerant flow is selected as an adjusting parameter during self-cleaning of the air-conditioner, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises: comparing a relationship between the target evaporating temperature and the actual evaporating temperature; and adjusting, according to a comparison result, a refrigerant flow corresponding to the to-be-cleaned heat exchanger.

The step of adjusting, according to a comparison result, a refrigerant flow corresponding to the to-be-cleaned heat exchanger specifically comprises: when Te>T0+B2, reducing the refrigerant flow; when Te<T0−B1, increasing the refrigerant flow; and when T0−B1≤Te≤T0+B2, keeping current operating state, wherein a value of B1 is 1-20° C. and a value of B2 is 1-10° C. A manner of adjusting the refrigerant flow may be implemented by adjusting an opening of a throttling device, for example, an expansion valve.

By adjusting the refrigerant flow corresponding to the to-be-cleaned heat exchanger when the heat exchanger is in a cleaning mode, the evaporating temperature of the heat exchanger can be controlled to be in a suitable frosting temperature range, so that a surface of the heat exchanger can frost quickly and uniformly; dirt is peeled off the surface of the heat exchanger by means of an acting force of frosting solidification, and then the surface of the heat exchanger is cleaned in a defrosting manner, so as to effectively improve the cleaning effect of the surface of the heat exchanger. In this embodiment, the throttling device is an expansion valve; during flow adjustment, the refrigerant flow is generally adjusted by adjusting a step count of the expansion valve.

When Te>T0+B2, the step of reducing the refrigerant flow comprises: when T0+B2<Te≤T0+B3, reducing the refrigerant flow at a rate of a2 s/step; and when Te>T0+B3, reducing the refrigerant flow at a rate of b2 s/step, wherein B3>B2 and a1<b1. a2 herein, for example, is 30, and b2, for example, is 10. T0+B3 herein, for example, is −10° C., and T0+B2, for example, is −15° C.

When Te>T0+B2, it indicates that the current evaporating temperature of the to-be-cleaned heat exchanger is excessively high, which is not good for surface frosting of the to-be-cleaned heat exchanger, and the evaporating temperature of the to-be-cleaned heat exchanger needs to be reduced, and therefore, the refrigerant flow needs to be reduced so that evaporating pressure is reduced; the refrigerant boils to absorb heat; and a surface temperature of the to-be-cleaned heat exchanger is reduced, so as to reduce the evaporating temperature of the to-be-cleaned heat exchanger.

During specific adjustment, if T0+B2<Te≤T0+B3, it indicates that the evaporating temperature of the to-be-cleaned heat exchanger is higher than the target evaporating temperature by a small amplitude, and therefore the refrigerant flow may be reduced at a low rate. On one aspect, it can be ensured that the evaporating temperature of the to-be-cleaned heat exchanger approaches to the target evaporating temperature, and on the other aspect, unstable operation of the air-conditioner caused by excessively quick adjustment of the refrigerant flow can also be avoided to improve working efficiency of the air-conditioner.

If Te>T0+B3, it indicates that the evaporating temperature of the to-be-cleaned heat exchanger is higher than the target evaporating temperature by a large amplitude, and the refrigerant flow needs to be reduced at a high rate, so that the evaporating temperature of the to-be-cleaned heat exchanger reaches the target evaporating temperature quickly, so as to improve the surface frosting or freezing efficiency of the to-be-cleaned heat exchanger, thereby improving the self-cleaning efficiency of the air-conditioner.

In the foregoing manner, a suitable manner for adjusting the refrigerant flow may be selected according to working conditions of the air-conditioner, so that not only quick adjustment on the evaporating temperature of the to-be-cleaned heat exchanger is ensured, but also excessively large fluctuation on the operation of the air-conditioner is avoided.

When Te>T0+B2, the refrigerant flow may further be reduced in the following manner: when T0+B2<Te≤T0+B3, reducing the refrigerant flow at a rate of (a2−c2t) S/step, and when Te>T0+B3, reducing the refrigerant flow at a rate of (b2−d2t) S/step. a2, for example, is 30; b2, for example, is 10; c2, for example, is 150; d2, for example, is 50, and t is adjusting time of the refrigerant flow, and a unit thereof is s.

Because in a process of adjusting the refrigerant flow, an adjusting amplitude need of the refrigerant flow gradually decreases with the reduction of the refrigerant flow; if the adjusting amplitude of the refrigerant flow keeps unchanged, adjusting accuracy of the refrigerant flow gradually decreases, and energy consumption of the compressor does not reach optimal state. Therefore, variable rate adjustment may be performed on the refrigerant flow in the foregoing manner, so as to ensure that the refrigerant flow can match the refrigerant flow that needs to be adjusted, so that the compressor can operate with high efficiency and power consumption of the compressor is reduced, thereby improving adjusting accuracy of the refrigerant flow.

When Te<T0−B1, the step of increasing the refrigerant flow comprises: when T0−B4≤Te<T0−B1, increasing the refrigerant flow according to a rate of a2 S/step; when Te<T0−B4, increasing the refrigerant flow according to a rate of b2 S/step, wherein B4>B1, a<b, T0−B4=−25° C., and T0−B1=−20° C.; a2, for example, is 30, and b2, for example, is 10.

When Te<T0−B1, it indicates that the current evaporating temperature of the to-be-cleaned heat exchanger is excessively low, which causes non-uniform surface frosting of the to-be-cleaned heat exchanger, and causes great reduction of working efficiency of the air-conditioner at the same time; the evaporating temperature of the to-be-cleaned heat exchanger needs to be improved, and therefore, the refrigerant flow needs to be increased, evaporating pressure in the to-be-cleaned heat exchanger needs to be improved, the cooling capacity of the to-be-cleaned heat exchanger needs to be reduced, and the evaporating temperature of the to-be-cleaned heat exchanger needs to be improved.

During specific adjustment, if T0−B4≤Te<T0−B1, it indicates that a difference between the evaporating temperature of the to-be-cleaned heat exchanger and the target evaporating temperature is small, and therefore the refrigerant flow may be increased at a low rate. On one aspect, it can be ensured that the evaporating temperature of the to-be-cleaned heat exchanger approaches to the target evaporating temperature, and on the other aspect, unstable operation of the air-conditioner caused by excessively quick adjustment of the refrigerant flow can also be avoided to improve working efficiency of the air-conditioner.

If Te<T0−B4, it indicates that the difference between the evaporating temperature of the to-be-cleaned heat exchanger and the target evaporating temperature is large, and the refrigerant flow needs to be increased at a high rate, so that the evaporating temperature of the to-be-cleaned heat exchanger reaches the target evaporating temperature quickly, so as to improve the surface frosting or freezing efficiency of the to-be-cleaned heat exchanger, thereby improving the self-cleaning efficiency of the air-conditioner.

In the foregoing manner, a suitable manner for adjusting the refrigerant flow may be selected according to working conditions of the air-conditioner, so that not only quick adjustment on the evaporating temperature of the to-be-cleaned heat exchanger is ensured, but also excessively large fluctuation on the operation of the air-conditioner is avoided.

When Te<T0−B1, the refrigerant flow may further be increased in the following manner: when T0−B4≤Te<T0−B1, increasing the refrigerant flow at a rate of (a2−c2t) S/step, and when Te<T0−B4, increasing the refrigerant flow at a rate of (b2−d2t) S/step. a2, for example, is 30; b2, for example, is 10; c2, for example, is 150; d2, for example, is 50, and t is adjusting time of the refrigerant flow, and a unit thereof is s.

Because in a process of adjusting the refrigerant flow, an adjusting amplitude need of the refrigerant flow gradually decreases with the reduction of the refrigerant flow; if the adjusting amplitude of the refrigerant flow keeps unchanged, adjusting accuracy of the refrigerant flow gradually decreases, and energy consumption of the compressor does not reach optimal state. Therefore, variable rate adjustment may be performed on the refrigerant flow in the foregoing manner, so as to ensure that the refrigerant flow can match the refrigerant flow that needs to be adjusted, so that the compressor can operate with high efficiency and power consumption of the compressor is reduced, thereby improving adjusting accuracy of the refrigerant flow.

The step of controlling the to-be-cleaned heat exchanger to frost comprises: when it is detected that Te<T0+C, controlling the to-be-cleaned heat exchanger to operate frosting for time of t1, and then controlling the to-be-cleaned heat exchanger to operate defrosting. When it is detected that Te<T0+C, it indicates that the surface of the to-be-cleaned heat exchanger has reached a frosting temperature, and therefore surface freezing or frosting of the to-be-cleaned heat exchanger can be ensured only by making the to-be-cleaned heat exchanger keep the current evaporating temperate for time of t1, so as to defrost the surface of the heat exchanger, and dust and impurities can be peeled off the surface of the to-be-cleaned heat exchanger, and then flow away with condensate water from the surface of the to-be-cleaned heat exchanger after defrosting to take away dirt and are discharged from a drain pipe of the air-conditioner, so as to automatically clean the heat exchanger. A value of C herein is 0-10° C., preferably, C is 2° C.; t1 is 3-15 min, and preferably t is 8 min.

In a process of adjusting an evaporating temperature of the surface of the to-be-cleaned heat exchanger, because at the moment, the to-be-cleaned heat exchanger is always in evaporating state, it can be considered that the to-be-cleaned heat exchanger is always an evaporator. To make the surface of the to-be-cleaned heat exchanger frost or freeze quickly, and form a uniform frost layer or ice layer on the surface of the to-be-cleaned heat exchanger, suction super heat of the air-conditioner may be controlled between 0° C. and 5° C., so as to ensure uniform distribution of refrigerant temperatures in the to-be-cleaned heat exchanger, thereby ensuring that a uniformly-distributed frost layer or ice layer can be formed on the surface of the to-be-cleaned heat exchanger to ensure the surface self-cleaning effect of the to-be-cleaned heat exchanger.

To further ensure that condensate water is uniformly distributed on the surface of the to-be-cleaned heat exchanger, so that the surface of the to-be-cleaned heat exchanger frosts or freezes uniformly, preferably, a hairbrush may be correspondingly provided on the surface of the to-be-cleaned heat exchanger; when the to-be-cleaned heat exchanger enters the self-cleaning mode, or before the to-be-cleaned heat exchanger enters the self-cleaning mode, the hairbrush is first controlled to brush on the surface of the to-be-cleaned heat exchanger to enable the condensate water to be distributed uniformly on the surface of the to-be-cleaned heat exchanger, and in a process of frosting and defrosting, the hairbrush may also be always kept brushing, so as to further improve the surface cleaning effect of the to-be-cleaned heat exchanger.

After the to-be-cleaned heat exchanger enters the self-cleaning mode and operates frosting for time of t2, and Te<T0+C still cannot be satisfied, a fan corresponding to the to-be-cleaned heat exchanger is controlled to stop operation for time of t3, and the fan corresponding to the to-be-cleaned heat exchanger is restarted to enter the defrosting mode until Te<T0 and time of t4 is kept.

If Te<T0+C still cannot be satisfied after the to-be-cleaned heat exchanger operates frosting for time of t2, it indicates that the current evaporating temperature of the surface of the to-be-cleaned heat exchanger cannot reach the frosting temperature, and therefore the evaporating temperature of the surface of the to-be-cleaned heat exchanger needs to be further reduced, and at the moment, the fan corresponding to the to-be-cleaned heat exchanger needs to be stopped to make air on the surface of the to-be-cleaned heat exchanger not circulate, and make cooling capacity accumulate on the surface of the to-be-cleaned heat exchanger, so that the evaporating temperature of the surface of the to-be-cleaned heat exchanger can quickly decrease to the frosting temperature. If Te<T0 after the fan corresponding to the to-be-cleaned heat exchanger stops operation for time of t3, it can be ensured that after the current state is kept for time of t4, the fan corresponding to the to-be-cleaned heat exchanger is restarted to enter a defrosting mode. Because the evaporating temperature of the surface of the to-be-cleaned heat exchanger has reached the frosting temperature when Te<T0, the surface of the to-be-cleaned heat exchanger can sufficiently frost or freeze only by keeping the state for time of t4, and then defrosting processing is performed on the to-be-cleaned heat exchanger to complete surface cleaning of the to-be-cleaned heat exchanger. t2 herein, for example, is 5 min; t3, for example, is 3 min; and t4, for example, is 5 min. Certainly, the time setting may also be correspondingly adjusted according to the type of the air-conditioner and the like.

When defrosting processing on the to-be-cleaned heat exchanger is performed, operation of the compressor may be stopped, and continuous operation of the fan is kept, so that the air-conditioner operates in energy-saving state to smoothly complete the defrosting operation.

After the air-conditioner enters the self-cleaning mode, operating parameters of the air-conditioner can be controlled to be preset values, and the preset values may be obtained by the air-conditioner by means of a network or obtained by a database stored in the air-conditioner. In this manner, suitable operating parameters can be selected by using optimized data of the network and optimized data of the air-conditioner itself, so as to improve the adjusting efficiency during self-cleaning of the air-conditioner.

The operating parameters of the air-conditioner comprise the operating frequency of the compressor, the rotation speed of the fan, and the refrigerant flow.

Figure 2:
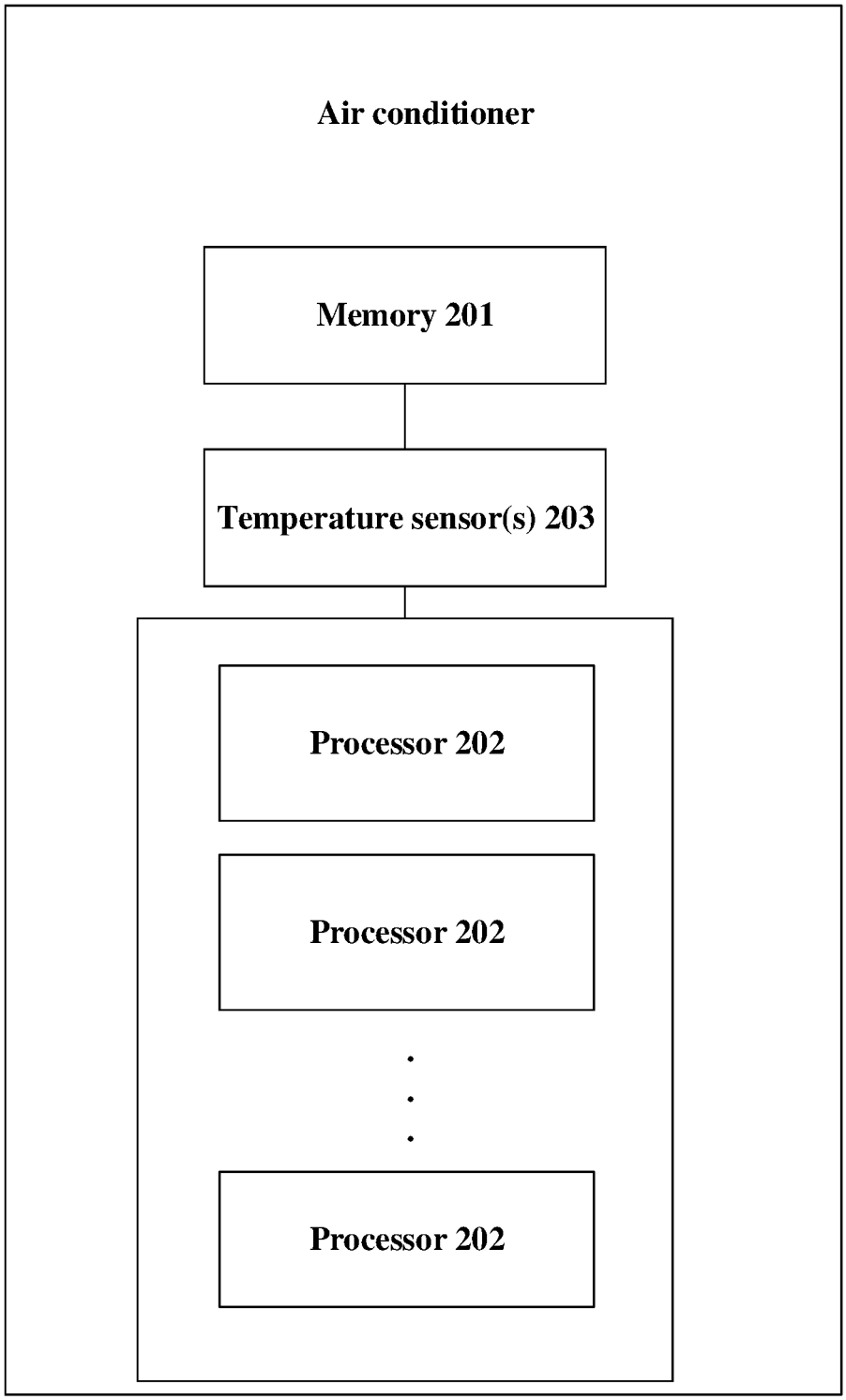
FIG. 2 is a structural illustration of an air conditioner according to an embodiment of the present invention.

As shown in FIG. 2, according to another aspect of the present invention, an air-conditioner is provided, comprising a memory 201 and one or more processors 202, a temperature sensor 203, wherein the memory 201 stores therein computer readable program codes, the temperature sensor 203 detects an ambient temperature of a to-be-cleaned heat exchanger, and the one or more processors 202 are configured to execute the computer readable program codes: to control the air-conditioner to enter a self-cleaning mode; to determine according to the detected ambient temperature, a target evaporating temperature of the to-be-cleaned heat exchanger; to adjust according to the target evaporating temperature and an actual evaporating temperature of the to-be-cleaned heat exchanger, an evaporating temperature of the to-be-cleaned heat exchanger, and controlling the to-be-cleaned heat exchanger to frost; and after a surface of the to-be-cleaned heat exchanger is covered with a frost layer or an ice layer, to control the air conditioner to enter a defrosting mode of the to-be-cleaned heat exchanger.

According to another aspect of the present invention, a self-cleaning method for an air-conditioner heat exchanger is provided, comprising: controlling, by a processor of an air-conditioner, the air-conditioner to enter a self-cleaning mode; detecting, by a temperature sensor of the air-conditioner, an ambient temperature of a to-be-cleaned heat exchanger, and determining, by the processor, according to the detected ambient temperature, a target evaporating temperature of the to-be-cleaned heat exchanger; adjusting, by the processor, according to the target evaporating temperature and an actual evaporating temperature of the to-be-cleaned heat exchanger, an evaporating temperature of the to-be-cleaned heat exchanger, and controlling, by the processor, the to-be-cleaned heat exchanger to frost; and after a surface of the to-be-cleaned heat exchanger is covered with a frost layer or an ice layer, controlling, by the processor, the air conditioner to enter a defrosting mode of the to-be-cleaned heat exchanger.

Preferably, the target evaporating temperature is determined by means of the following formula:

$$T0=k*T-A \text{ or } T0=T1\text{, taking a smaller one of them, wherein}$$

k is a calculating coefficient, and a value thereof is 0.7-1; A is a temperature compensation value, and a value thereof is 4-25° C.; T is the ambient temperature of the to-be-cleaned heat exchanger; −10° C.≤T1<0° C.

Preferably, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises: comparing a relationship between the target evaporating temperature and the actual evaporating temperature; and adjusting an operating frequency of a compressor according to a comparison result.

Preferably, the step of adjusting an operating frequency of a compressor according to a comparison result comprises:

when Te>T0+B2, improving the operating frequency of the compressor;

when Te<T0−B1, reducing the operating frequency of the compressor; and when T0−B1≤Te≤T0+B2, keeping current operating state, wherein a value of B1 is 1-20° C. and a value of B2 is 1-10° C.

Preferably, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises: comparing a relationship between the target evaporating temperature and the actual evaporating temperature; and adjusting, according to a comparison result, a rotation speed of a fan corresponding to the to-be-cleaned heat exchanger.

Preferably, the step of adjusting, according to a comparison result, a rotation speed of a fan corresponding to the to-be-cleaned heat exchanger comprises:

when Te>T0+B2, reducing the rotation speed of the fan;

when Te<T0−B1, improving the rotation speed of the fan; and when T0−B1≤Te≤T0+B2, keeping current operating state, wherein a value of B1 is 1-20° C. and a value of B2 is 1-10° C.

Preferably, the step of adjusting, according to the target evaporating temperature and an actual evaporating temperature of the to-be-cleaned heat exchanger, an evaporating temperature of the to-be-cleaned heat exchanger, and controlling the to-be-cleaned heat exchanger to frost comprises: comparing a relationship between the target evaporating temperature and the actual evaporating temperature; and adjusting, according to a comparison result, a refrigerant flow that flows through the to-be-cleaned heat exchanger.

Preferably, the step of adjusting, according to a comparison result, a refrigerant flow that flows through the to-be-cleaned heat exchanger comprises:

when Te>T0+B2, reducing the refrigerant flow;

when Te<T0−B1, increasing the refrigerant flow; and when T0−B1≤Te≤T0+B2, keeping current operating state, wherein a value of B1 is 1-20° C. and a value of B2 is 1-10° C.

Preferably, the step of controlling the to-be-cleaned heat exchanger to frost comprises:

when it is detected that Te<T0+C, controlling the to-be-cleaned heat exchanger to operate frosting for time of t1, and then controlling the to-be-cleaned heat exchanger to operate defrosting.

Preferably, after the to-be-cleaned heat exchanger operates frosting for time of t2, and Te<T0+C still cannot be satisfied, a fan corresponding to the to-be-cleaned heat exchanger is controlled to stop operation for time of t3, and the fan corresponding to the to-be-cleaned heat exchanger is restarted to enter the defrosting mode until Te<T0 and time of t4 is kept.

It should be understood that the present invention is not limited to the flows and structures that have been described above and shown in the drawings, and various modifications and changes can be made to the present invention without departing from the scope of the present invention. The scope of the present invention is limited only by the appended claims.

What is claimed is:

1. A method for self-cleaning an air conditioner heat exchanger, the method comprising:

controlling, by a processor of an air conditioner, the air conditioner to enter a self-cleaning mode;

detecting, by a first temperature sensor of the air conditioner, an ambient temperature of a to-be-cleaned heat exchanger, and determining, by the processor, according to the detected ambient temperature, a target evaporating temperature of the to-be-cleaned heat exchanger;

adjusting, by the processor, according to a difference between the target evaporating temperature and an actual evaporating temperature of the to-be-cleaned heat exchanger, an evaporating temperature of the to-be-cleaned heat exchanger, and controlling, by the processor, the to-be-cleaned heat exchanger to frost, wherein the actual evaporating temperature of the to-be-cleaned heat exchanger is detected by a second temperature sensor; and after a surface of the to-be-cleaned heat exchanger is covered with a frost layer or an ice layer, controlling, by the processor, the air conditioner to enter a defrosting mode of the to-be-cleaned heat exchanger, wherein the target evaporating temperature is determined by the following formula:

$$T0=k*T-A \text{ or } T0=T1, \text{ taking a smaller one of them, wherein}$$

T0 is the target evaporating temperature, k is a calculating coefficient, and a value thereof is 0.7-1; A is a temperature compensation value, and a value thereof is 4-25° C.; T is the ambient temperature of the to-be-cleaned heat exchanger; and T1 is a predetermined constant selected from a range of −10° C.≤T1<0° C. to ensure that water vapor turns to water when air passes through the heat exchanger, wherein adjusting, by the processor, according to a difference between the target evaporating temperature and an actual evaporating temperature of the to-be-cleaned heat exchanger, the evaporating temperature of the to-be-cleaned heat exchanger, and controlling the to-be-cleaned heat exchanger to frost comprises:

comparing a relationship between the target evaporating temperature and the actual evaporating temperature; and adjusting an operating frequency of a compressor according to a comparison result, wherein adjusting an operating frequency of a compressor according to a comparison result comprises:

when Te>T0+B2, increasing the operating frequency of the compressor;

when Te<T0−B1, reducing the operating frequency of the compressor; and when T0−B1≤Te≤T0+B2, keeping current operating state, wherein Te is the actual evaporating temperature, B1 is a predetermined constant selected from a range of 1−20° C. to prevent non-uniform surface frosting due to too high of an actual evaporating temperature Te, and B2 is predetermined constant selected from a range of 1−10° C. to prevent poor surface frosting due to too low of an actual evaporating temperature Te, wherein when Te>T0+B2, the operating frequency of the compressor may also be improved in the following manner:

when T0+B2<Te≤T0+B3, increasing the operating frequency of the compressor according to a rate of (a-ct) Hz/s; and when Te>T0+B3, increasing the operating frequency of the compressor according to a rate of (b-dt)Hz/s, wherein B3 is a predetermined constant selected to be greater than B2 and to prevent a large deviation in the actual evaporating temperature Te from the target evaporating temperature T0, a, b, c and d are predetermined constants, a and c are selected to control the operating frequency to increase over time at a first rate, b and d are selected to control the operating frequency to increase over time at a second rate greater than the first rate, and t is adjusting time of a refrigerant flow.

2. The method for self-cleaning an air conditioner heat exchanger according to claim 1, wherein adjusting, according to a difference between the target evaporating temperature and an actual evaporating temperature of the to-be-cleaned heat exchanger, an evaporating temperature of the to-be-cleaned heat exchanger, and controlling the to-be-cleaned heat exchanger to frost comprises:

comparing a relationship between the target evaporating temperature and the actual evaporating temperature; and adjusting, according to a comparison result, a rotation speed of a fan corresponding to the to-be-cleaned heat exchanger.

3. The method for self-cleaning an air conditioner heat exchanger according to claim 2, wherein adjusting, according to a comparison result, a rotation speed of a fan corresponding to the to-be-cleaned heat exchanger comprises:

when Te>T0+B2, reducing the rotation speed of the fan;

when Te<T0-B1, improving the rotation speed of the fan; and when T0−B1≤Te≤T0+B2, keeping current operating state, wherein a value of B1 is 1-20° C. and a value of B2 is 1-10° C.

4. The method for self-cleaning an air conditioner heat exchanger according to claim 1, wherein adjusting, according to a difference between the target evaporating temperature and an actual evaporating temperature of the to-be-cleaned heat exchanger, an evaporating temperature of the to-be-cleaned heat exchanger, and controlling the to-be-cleaned heat exchanger to frost comprises:

comparing a relationship between the target evaporating temperature and the actual evaporating temperature; and adjusting, according to a comparison result, a refrigerant flow that flows through the to-be-cleaned heat exchanger.

5. The method for self-cleaning an air conditioner heat exchanger according to claim 1, wherein adjusting, according to a comparison result, a refrigerant flow that flows through the to-be-cleaned heat exchanger comprises:

when Te>T0+B2, reducing the refrigerant flow;

when Te<T0−B1, increasing the refrigerant flow; and when T0−B1≤Te≤T0+B2, keeping current operating state, wherein a value of B1 is 1-20° C. and a value of B2 is 1-10° C.

6. The method for self-cleaning an air conditioner heat exchanger according to claim 1, wherein controlling the to-be-cleaned heat exchanger to frost comprises:

when it is detected that Te<T0+C, controlling the to-be-cleaned heat exchanger to operate frosting for time of t1, and then controlling the to-be-cleaned heat exchanger to operate defrosting, wherein a value of C is 0-10° C.

7. The method for self-cleaning an air conditioner heat exchanger according to claim 3, wherein after the to-be-cleaned heat exchanger operates frosting for time of t2, and Te<T0+C still cannot be satisfied, a fan corresponding to the to-be-cleaned heat exchanger is controlled to stop operation for time of t3, and the fan corresponding to the to-be-cleaned heat exchanger is restarted to enter the defrosting mode until Te<T0 and time of t4 is kept.

8. An air conditioner, comprising a memory and one or more processors, a first temperature sensor and a second temperature sensor, wherein the memory stores therein computer readable program codes, the first temperature sensor detects an ambient temperature of a to-be-cleaned heat exchanger, the second temperature sensor detects an actual evaporating temperature of the to-be-cleaned heat exchanger, and the one or more processors are configured to execute the computer readable program codes:

to control the air conditioner to enter a self-cleaning mode;

to determine according to the detected ambient temperature, a target evaporating temperature of the to-be-cleaned heat exchanger;

to adjust according to a difference between the target evaporating temperature and the actual evaporating temperature of the to-be-cleaned heat exchanger, an evaporating temperature of the to-be-cleaned heat exchanger, and controlling the to-be-cleaned heat exchanger to frost; and after a surface of the to-be-cleaned heat exchanger is covered with a frost layer or an ice layer, to control the air conditioner to enter a defrosting mode of the to-be-cleaned heat exchanger, wherein the target evaporating temperature is determined by means of the following formula:

$T0=k*T-A$ or $T0=T1$, taking a smaller one of them, wherein

T0 is the target evaporating temperature, k is a calculating coefficient, and a value thereof is 0.7-1; A is a temperature compensation value, and a value thereof is 4-25° C.; T is the ambient temperature of the to-be-cleaned heat exchanger; and T1 is a predetermined constant selected from a range of −10° C.≤T1<0° C. to ensure that water vapor turns to water when air passes through the heat exchanger, wherein to adjust according to a difference between the target evaporating temperature and an actual evaporating temperature of the to-be-cleaned heat exchanger, an evaporating temperature of the to-be-cleaned heat exchanger, and controlling the to-be-cleaned heat exchanger to frost comprises:

to compare a relationship between the target evaporating temperature and the actual evaporating temperature; and to adjust an operating frequency of a compressor according to a comparison result, wherein to adjust an operating frequency of a compressor according to a comparison result comprises:

when Te>T0+B2, to increase the operating frequency of the compressor;

when Te<T0−B1, to reduce the operating frequency of the compressor; and when T0−B1≤Te≤T0+B2, to keep current operating state, wherein Te is the actual evaporating temperature, B1 is a predetermined constant selected from a range of 1−20° C. to prevent non-uniform surface frosting due to too high of an actual evaporating temperature Te, and B2 is predetermined constant selected from a range of 1−10° C. to prevent poor surface frosting due to too low of an actual evaporating temperature Te, wherein when Te>T0+B2, the operating frequency of the compressor may also be improved in the following manner:

when T0+B2<Te≤T0+B3, to increase the operating frequency of the compressor according to a rate of (a-ct) Hz/s; and when Te>T0+B3, to increase the operating frequency of the compressor according to a rate of (b-dt)Hz/s, wherein B3 is a predetermined constant selected to be greater than B2 and to prevent a large deviation in the actual evaporating temperature Te from the target evaporating temperature T0, a, b, c and d are predetermined constants, a and c are selected to control the operating frequency to increase over time at a first rate, b and d are selected to control the operating frequency to increase over time at a second rate greater than the first rate, and t is adjusting time of a refrigerant flow.

9. A method for self-cleaning an air conditioner heat exchanger, wherein, comprising:

controlling, by a processor of an air conditioner, the air conditioner to enter a self-cleaning mode;

detecting, by a first temperature sensor of the air conditioner, an ambient temperature of a to-be-cleaned heat exchanger, and determining, by the processor, according to the detected ambient temperature, a target evaporating temperature of the to-be-cleaned heat exchanger;

adjusting, by the processor, according to a difference between the target evaporating temperature and an actual evaporating temperature of the to-be-cleaned heat exchanger, an evaporating temperature of the to-be-cleaned heat exchanger, and controlling, by the processor, the to-be-cleaned heat exchanger to frost, wherein the actual evaporating temperature of the to-be-cleaned heat exchanger is detected by a second temperature sensor; and after a surface of the to-be-cleaned heat exchanger is covered with a frost layer or an ice layer, controlling, by the processor, the air conditioner to enter a defrosting mode of the to-be-cleaned heat exchanger, wherein the target evaporating temperature is determined by means of the following formula:

$T0=k*T-A$ or $T0=T1$, taking a smaller one of them, wherein

T0 is the target evaporating temperature, k is a calculating coefficient, and a value thereof is 0.7-1; A is a temperature compensation value, and a value thereof is 4-25° C.; T is the ambient temperature of the to-be-cleaned heat exchanger; and T1 is a predetermined constant selected from a range of −10° C.≤T1<0° C. to ensure that water vapor turns to water when air passes through the heat exchanger, wherein adjusting, according to a difference between the target evaporating temperature and an actual evaporating temperature of the to-be-cleaned heat exchanger, an evaporating temperature of the to-be-cleaned heat exchanger, and controlling the to-be-cleaned heat exchanger to frost comprises:

comparing a relationship between the target evaporating temperature and the actual evaporating temperature; and adjusting an operating frequency of a compressor according to a comparison result, wherein adjusting an operating frequency of a compressor according to a comparison result comprises:

when Te>T0+B2, increasing the operating frequency of the compressor;

when Te<T0−B1, reducing the operating frequency of the compressor; and when T0−B1≤Te≤T0+B2, keeping current operating state, wherein Te is the actual evaporating temperature, B1 is a predetermined constant selected from a range of 1−20° C. to prevent non-uniform surface frosting due to too high of an actual evaporating temperature Te, and B2 is predetermined constant selected from a range of 1−10° C. to prevent poor surface frosting due to too low of an actual evaporating temperature Te, wherein when Te>T0+B2, the operating frequency of the compressor may also be improved in the following manner:

when T0+B2<Te≤T0+B3, increasing the operating frequency of the compressor according to a rate of (a-ct) Hz/s; and when Te>T0+B3, increasing the operating frequency of the compressor according to a rate of (b-dt)Hz/s, wherein B3 is a predetermined constant selected to be greater than B2 and to prevent a large deviation in the actual evaporating temperature Te from the target evaporating temperature T0, a, b, c and d are predetermined constants, a and c are selected to control the operating frequency to increase over time at a first rate, b and d are selected to control the operating frequency to increase over time at a second rate greater than the first rate, and t is adjusting time of a refrigerant flow.

* * * * *